US008944821B2

(12) United States Patent
Tengblad

(10) Patent No.: US 8,944,821 B2
(45) **Date of Patent: *Feb. 3, 2015**

(54) SIMULATION SYSTEM AND METHOD FOR DETERMINING THE COMPASS BEARING OF DIRECTING MEANS OF A VIRTUAL PROJECTILE/MISSILE FIRING DEVICE

(75) Inventor: Adam Tengblad, Huskvarna (SE)

(73) Assignee: SAAB AB, Linköping (SE)

( * ) Notice: Subject to any disclaimer, the term of this patent is extended or adjusted under 35 U.S.C. 154(b) by 1082 days.

This patent is subject to a terminal disclaimer.

(21) Appl. No.: 11/812,473

(22) Filed: Jun. 19, 2007

(65) Prior Publication Data

US 2008/0160486 A1 Jul. 3, 2008

(30) Foreign Application Priority Data

Jun. 19, 2006 (EP) ..... 06115654

(51) Int. Cl.
*F41G 3/26* (2006.01)

(52) U.S. Cl.
CPC ..... *F41G 3/2644* (2013.01); *F41G 3/2611* (2013.01)
USPC ..... 434/11; 434/16; 434/19

(58) Field of Classification Search
CPC .... F41G 3/2622; F41G 3/2644; F41G 3/2655
USPC ..... 434/11, 16, 19, 20, 21, 23, 27; 463/2, 463/52
See application file for complete search history.

(56) References Cited

U.S. PATENT DOCUMENTS

| | | | | |
|---|---|---|---|---|
| 3,832,791 | A * | 9/1974 | Robertsson | 434/22 |
| 4,478,581 | A * | 10/1984 | Goda | 434/22 |
| 4,606,724 | A * | 8/1986 | Chanforan et al. | 434/20 |
| 4,650,419 | A | 3/1987 | Francke et al. | |
| 5,823,780 | A * | 10/1998 | Arye et al. | 434/38 |
| 6,084,989 | A * | 7/2000 | Eppler | 382/293 |
| 6,139,323 | A * | 10/2000 | Christians et al. | 434/16 |
| 6,166,744 | A * | 12/2000 | Jaszlics et al. | 345/629 |
| 6,260,466 | B1 | 7/2001 | Humphreys | |
| 6,973,865 | B1 * | 12/2005 | Duselis et al. | 89/41.05 |

(Continued)

FOREIGN PATENT DOCUMENTS

| | | |
|---|---|---|
| DE | 3329747 A1 | 3/1985 |
| EP | 0154809 A | 9/1985 |

(Continued)

OTHER PUBLICATIONS

European Search Report—Feb. 2, 2007.

*Primary Examiner* — Bruk Gebremichael
(74) *Attorney, Agent, or Firm* — Venable LLP; Eric J. Franklin; Jeffri A. Kaminski

(57) ABSTRACT

A simulation system including at least one virtual projectile/missile firing device associated to a determined position and having a movable director arranged to direct a virtual projectile/missile towards a target and an image capturer arranged to capture at least one image of a scene in front of the director. The simulation system includes a terrain database with the positions of landmarks marked, a processor arranged to process the image of the scene so as to identify at least one landmark of the terrain database in the image and the processor is further arranged to determine a compass bearing of the director based on at least the position of the virtual projectile/missile and the position of the identified at least one landmark.

17 Claims, 2 Drawing Sheets

(56) References Cited

U.S. PATENT DOCUMENTS

| | | | | |
|---|---|---|---|---|
| 7,121,464 | B2 * | 10/2006 | White | 235/400 |
| 2002/0163521 | A1 * | 11/2002 | Ellenby et al. | 345/502 |
| 2003/0136900 | A1 * | 7/2003 | Shechter et al. | 250/222.1 |
| 2003/0152892 | A1 * | 8/2003 | Huang et al. | 434/11 |
| 2003/0180038 | A1 * | 9/2003 | Gordon | 396/263 |
| 2004/0031184 | A1 * | 2/2004 | Hope | 42/111 |
| 2004/0219491 | A1 * | 11/2004 | Shlomo | 434/11 |
| 2004/0247174 | A1 * | 12/2004 | Lyons et al. | 382/154 |
| 2005/0202877 | A1 * | 9/2005 | Uhlir et al. | 463/43 |
| 2005/0272011 | A1 * | 12/2005 | Herman et al. | 434/11 |
| 2006/0005447 | A1 * | 1/2006 | Lenner et al. | 42/111 |
| 2006/0007308 | A1 * | 1/2006 | Ide et al. | 348/143 |
| 2006/0050929 | A1 * | 3/2006 | Rast et al. | 382/103 |
| 2006/0201046 | A1 * | 9/2006 | Gordon | 42/119 |
| 2007/0015116 | A1 * | 1/2007 | Coleman | 434/16 |
| 2007/0035562 | A1 * | 2/2007 | Azuma et al. | 345/633 |

FOREIGN PATENT DOCUMENTS

| | | | |
|---|---|---|---|
| EP | 0155985 | A2 | 10/1985 |
| EP | 1643206 | A1 | 4/2006 |

* cited by examiner

SIMULATION SYSTEM AND METHOD FOR DETERMINING THE COMPASS BEARING OF DIRECTING MEANS OF A VIRTUAL PROJECTILE/MISSILE FIRING DEVICE

CROSS-REFERENCE TO RELATED APPLICATIONS

This application claims priority to European patent application 06115654.3 filed 19 Jun. 2006.

TECHNICAL FIELD OF THE INVENTION AND PRIOR ART

The present invention relates to a simulation system comprising at least one virtual projectile/missile firing device associated to a determined position and having movable directing means arranged to direct a virtual projectile/missile (i.e. a self-propelling weapon, such as a rocket, or a non-self-propelling weapon that is thrown or projected) towards a target and means arranged to capture at least one image of a scene in front of the directing means.

The present invention also relates to a method for determining the compass bearing of directing means of a virtual projectile/missile firing device comprising the steps of determining the position of the virtual projectile/missile firing device and capturing at least one image of the target scene in front of the directing means.

Weapon simulators are widely used to take the place of actual weapons during simulation exercises.

EP 1 643 206 relates to a simulation system comprising a virtual projectile/missile firing device having movable directing means arranged to direct a virtual projectile/missile towards a target and means arranged to determine the positions of said virtual projectile/missile firing device and the target. The simulation system further comprises means arranged to capture at least one image of the target scene in front of the directing means and means arranged to process the, or each, image so as to determine the compass bearing of the directing means.

A disadvantage of such a simulation system is that the target has to be visible in the target scene image. If the target is hidden behind an obstacle of some kind or is beyond the horizon, the image can not be used in calculating the compass bearing.

SUMMARY OF THE INVENTION

One object of the present invention is to provide a simulation system that allows the compass bearing of the directing means of a virtual projectile/missile firing device to be accurately determined even when there is no visual contact between a shooter and target, and accordingly, the target is not visible in the image scene. Thereby, accurate calculation of the ballistic trajectory of a virtual projectile/missile will be enabled even without visual contact with the target.

This object is fulfilled by an embodiment of a simulation system including at least one virtual projectile/missile firing device, such as a tank, associated to a determined position and having movable directing means, such as a gun barrel, arranged to direct a virtual projectile/missile, such as a virtual anti-tank missile, towards a target and means arranged to capture at least one image of the scene in front of the directing means. The simulation system is characterized in that it comprises a terrain database with the positions of landmarks marked, in that it comprises processing means arranged to process the image of the scene so as to identify at least one landmark of the terrain database in the image and in that said processing means further are arranged to determine the compass bearing of the directing means based on at least the position of the virtual projectile/missile firing device and the position of the identified at least one landmark. Preferably, both the geographical position of the at least one landmark, given in a local or global coordinate system, and the location in the image of the at least one landmark are used in the determination of the compass bearing, thereby providing high accuracy in the determination.

When a virtual projectile/missile is fired, the simulation system is provided with information concerning how the directing means is oriented from the captured scene image. At least one landmark in the in the scene image is identified in a known position, wherein the position is a coordinate given in the local or global coordinate system, as discussed above. The landmark is for example identified by correlating extracted topographic data of the scene image with topographic data of a terrain database. The accurate compass bearing of the directing means of the virtual projectile/missile firing device can therefore be accurately determined using the geographical position of the at least one landmark and its location in the image, and information about the position of the virtual projectile/missile firing device. Accurate determination of the compass bearing of the directing means allows a more accurate ballistic trajectory of the virtual projectile/missile to be determined and this consequently enhances the realism and improves the effectiveness of the simulation exercise.

According to one embodiment of the invention, the image capturing means is mounted on the directing means, whereby the orientation of the image capturing means with respect to the directing means is known. Alternatively, the image capturing means is incorporated into the bore sight of the directing means.

The landmarks can be either objects formed naturally in the terrain, such as mountains, large stones or trees, or objects built by man, such as cottages, houses, walls, or mounds of stones.

The inventive simulation system requires relatively little equipment to be mounted on the participants taking part in a simulation exercise. Participants may be moving or stationary vehicles, aircraft or sea-going vessels, movable or stationary weapons, buildings, fixed or movable structures and/or people.

One advantage of determining the compass bearing by using known landmarks in the terrain instead of a measured position of a target, as in the prior art technique, is that the position of a stationary landmark can be determined once for all in contrast to a target, which usually is a moving object. Thereby, a proportionally large effort can spent on measuring the coordinates for the landmarks, thereby obtaining coordinates with a high accuracy. This is in contrast to the continuous updating of the determination of the position of a target, wherein one is obliged to use less complex measuring techniques such as using data from a global positioning system (GPS) or a differential global positioning system (DGPS). The higher accuracy of the position data for the landmarks of course results in a higher accuracy in the determination of the compass bearing.

In order to further improve the accuracy in the determination of the compass bearing, the distance between virtual projectile/missile firing device and the at least one landmark can be determined using a laser-based distance sensor, a so called laser range finder. Accordingly, a laser beam is emitted from the virtual projectile/missile firing device towards at least one identified landmark, at least a part of said laser beam reflected in the landmark is received at the virtual projectile/ missile firing device (1), the distance to said landmark is determined based on a time of flight of said reflected laser beam and said determined distance is used in the determination of the compass bearing. As discussed above, the landmarks are usually stationary and their positions can be measured with high accuracy. The virtual projectile/missile firing device on the other hand is usually movable and accordingly, the position is measured using less complex measuring techniques such as using data from a global positioning system (GPS) or a differential global positioning system (DGPS). The accuracy of the determined position of the virtual projectile/missile firing device is thus the weak point in determining the compass bearing. In practice, the determined distance between the virtual projectile/missile and the landmark can therefore be used for improving the accuracy of the position measurement of the virtual projectile/missile firing device.

According to an embodiment of the invention the simulation system also comprises compass means to provide a preliminary indication of the compass bearing of the directing means. The preliminary indication of the compass bearing may be used to roughly determine the coordinates of the terrain area visible in the captured image. A subset of the data of the terrain database in accordance with the determined coordinates can then be chosen for correlation with the image.

According to another embodiment of the invention, the image capturing means comprises at least one optic or infrared camera. The image capturing means are optionally arranged to take wide-angle photographs and transform them into digital panoramic images. A software program may optionally be used to generate a three-dimensional image of at least part of the scene.

According to an embodiment of the invention, the simulation system comprises means to determine the position of the target, and if the target is visible in the image of the scene, the processing means are arranged to determine the compass bearing of the directing means also based on the position of the target. The target is usually movable and the position can then be determined for example using a global positioning system (GPS) or differential global positioning system (DGPS). If the target is stationary, its position is preferably marked in the database and accordingly dealt with as a landmark.

According to another embodiment of the invention the simulation system comprises means to log the time at which the, or each, image of a target scene is captured.

According to a further embodiment of the invention the simulation system comprises a central network, such as a radio network, arranged to receive/send/store and/or communicate information concerning the position of said at least one virtual projectile/missile firing device and/or the compass bearing of its directing means to any, or all of the participants in a simulation exercise and optionally to a third party. All of the participants in a simulation exercise therefore transmit time-logged information concerning the position and compass bearing to the central network.

The present invention also concerns a method for determining the compass bearing of directing means of a virtual projectile/missile firing device, comprising the steps of determining the position of the virtual projectile/missile firing device and capturing at least one image of the scene in front of the directing means. The method is characterized in that it also comprises the step of processing the, or each, image in order to identify at least one landmark and to associate said landmark to a position using data in an terrain database and to determine the compass bearing of the directing means using information concerning the position of at least one landmark in the, or each, image and the position of the virtual projectile/missile firing device.

In accordance with one embodiment of the method, the landmark is identified and its position is determined by correlating topographic data extracted from the image with data of the terrain database.

In accordance with a preferred embodiment, the method comprises the steps of obtaining a preliminary indication of the compass bearing of the directing means and of determining a relevant geographic area of the terrain database to be searched, based on the preliminary indication, in the determination of the position of the landmark.

The present invention furthermore concerns a computer program containing computer program code means for making a computer or processor execute image processing of at least one target scene provided by a simulation system according to any of the embodiments described above or obtained using a method according to any of the embodiments disclosed herein in order to determine the compass bearing of the directing means of a virtual projectile/missile firing device.

According to an embodiment of the invention the computer program is stored by means of a computer-readable medium.

The system, the method and the computer program according to the present invention are intended for simulating the effect any projectile/missile, such as an anti-tank missile, anti-aircraft missile, anti-sea-craft missile, a chemical, biological or nuclear device, fired from any stationary or moving virtual projectile/missile firing device.

Further advantages as well as advantageous features of the invention appear from the following description and the other dependent claims.

Figure 1:
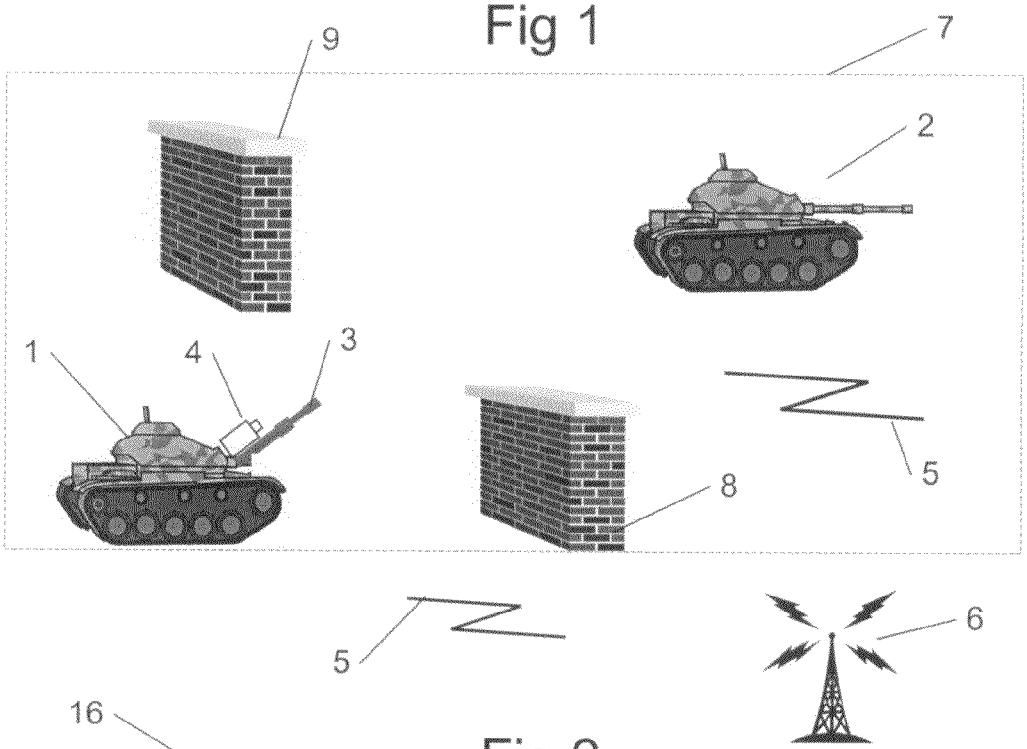
FIG. 1 shows very schematically a simulation system according to the present invention adapted for simulating tank fire in a training exercise.

The following description and drawings are not intended to limit the present invention to the embodiment disclosed. The embodiments disclosed merely exemplify the principles of the present invention.

It should be noted that the drawing is not drawn to scale and that the size of certain features has been exaggerated for the sake of clarity.

DETAILED DESCRIPTION OF AN EMBODIMENT OF THE INVENTION

FIG. 1 shows a simulation system used to simulate the firing of virtual anti-tank projectiles/missiles from a first tank 1 at a second tank 2 during a simulation exercise in a training field 7. The first tank 1, in the herein described example, acting as a shooter, comprises a gun barrel 3 that is movable by means of the revolvable turret on which it is mounted and which is arranged to direct a virtual anti-tank projectile/missile towards the second tank 2 acting as a target.

The first and second tanks 1, 2 are equipped with sensors, such as GPS-sensors, turret traversing sensors, a compass to give a rough indication of the compass bearing of the gun barrel 3, a gyroscope and gun barrel orientation sensors that provide information concerning the elevation and rotation of the gun barrel 3 towards the vertical plane. Additional sensors, such as a wind sensor may also be utilized if such information is to be considered in calculating the ballistic trajectory of the virtual anti-tank projectile/missile.

Time-logged information 5 concerning the position and orientation of the first and second tanks 1, 2 and parts thereof is transmitted to a central network 6. This information 5 is saved so as to be available for searches when information concerning the position of a tank 1, 2, at a certain time is requested.

A camera 4 is mounted at the bottom of the gun barrel 3 of the first tank 1 in a fixed and known position with respect to the gun barrel 3. Alternatively, use can be made of the tank's existing equipment such as a video camera and/or an infrared camera. The camera 4 is used to capture at least one image of the scene in front of the gun barrel 3 and the image is then processed to accurately determine the compass bearing of the gun barrel 3, as will be discussed in detail below. A number of landmarks 8, 9 (two are displayed in FIG. 2) at accurately measured positions are present within the training field 7. The number of landmarks 8, 9 and locations of the landmarks are in one example chosen such that the scene captured by the camera 4 always includes at least one landmark, as long as the first tank 1, acting as the shooting tank, is within the training field 7. In the shown FIG. 2, the landmarks are built walls. The landmarks can however be anything identifiable in the terrain, such as a building, steep hill, a large stone, or a tree.

Figure 2:
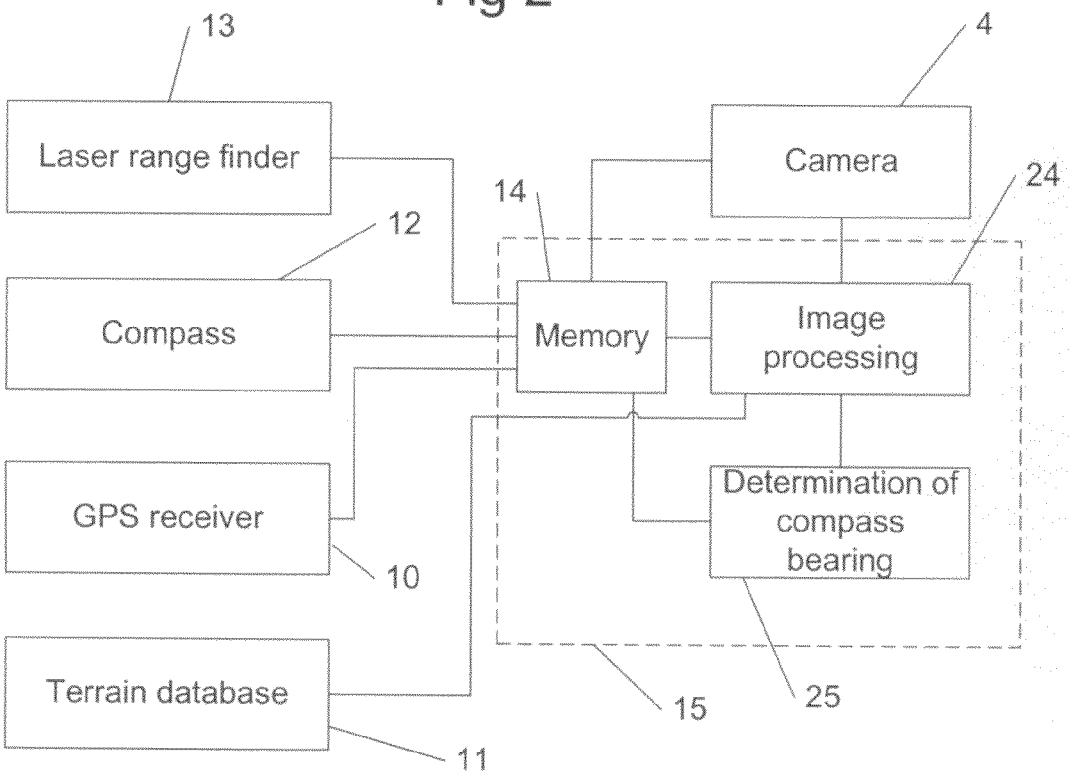
FIG. 2 is a block diagram over a device implemented in at least one of the tanks in FIG. 1.

In FIG. 2, a device 16 for determining the compass bearing of the directing means 3 of a virtual projectile/missile firing device in the form of the first tank 1 comprises said camera 4, a processing unit 15, a GPS receiver 10, a terrain database 11, a compass 12 and a laser range finder 13. The processing unit is in one example formed as a computer program in an computer. At least the camera 4 and compass 12 are arranged at the shooting tank 1, preferably along with the GPS receiver 10 and laser range finder 13, while the processing unit 15 and terrain database 11 are either arranged at the tank or at a remote location. In the latter case, data to/from the parts of the device 16 located at the tank are communicated from/to the remote location for example via the central network 6 or by other means of wireless communication such as radio, IR, etc. In the first mentioned case, wherein all parts of the device 16 are located at the first tank 1, communication between the parts of the device 16 is provided either by means of electrical cables or by means of wireless communication.

The camera 4 is for example activated at detection of firing of a shot. There are today many known ways of detecting firing of a shot, for example by detecting a fire trigger signal from a fire computer or by using means arranged to sense acoustic vibrations. However, this will not be described in detail herein. It is just assumed that firing of a shot with real of simulated ammunition is detected. The event of firing a shot is time-logged. A data representation of each captured image is saved in a memory 14, in the example of FIG. 2 incorporated in the processing unit 15. Further, the data representation of the image is fed to an image processing unit 24 of the processing unit 15, either directly or via the memory 14.

In connection with the activation of the camera, a reading of the bearing of the compass 12 is measured and fed to the memory 14. Also, the geographical position of the tank 1 measured by the GPS-receiver 10 is fed to the memory 14. The laser range finder 13 is arranged to, upon activation measure the distance to one of the landmarks and feed the information about the measured distance and an identity of the landmark in question to the memory 14. The laser range finder 13 is in one example activated in connection with the activation of the camera 4. In another example the camera 4 is activated upon activation of the laser range finder 13.

The image processing unit 24 of the processing unit 15 is arranged to search the data representation of the image stored in the memory for the landmarks 8, 9. The position of the shooting tank 1 provided by the GPS-receiver 10 and the bearing measured by the compass 12 together give an indication as to the geographical location of the scene visible in the image. A subset of the terrain data coinciding with the geographical location estimated in accordance with the above can then be chosen from the terrain database 11 for further processing in order to identify the landmark(s) in the image.

In one example of the invention, the terrain database 11 contains information about the shape and size of the landmarks along with their geographical positions. The position of the shooting tank 1 provided by the GPS-receiver 10 and the bearing of the compass 12 then indicates from which direction the landmarks are visible and the shape of the visible side of the landmarks are determined for the chosen subset for correlation with the image. When a match is provided between the terrain data and the data of the image representation, the coordinates of the landmark(s) in the image are known. This information is fed from the image processing unit 24 to a unit 25 for determining the compass bearing In an alternative example, the terrain database contains topographic data for the whole training field 7, not only the landmarks. The chosen subset of the data of the terrain database is then used for correlation with topographic data of the image representation. When a match is provided between the terrain data and the topographic data of the image representation, the coordinates of objects in the image are known. This information is fed from the image processing unit 24 to a unit 25 for determining the compass bearing The technology of correlating two images is today well known. Accordingly, methods which can be used in the image processing unit 24 for correlating the image with the data of the terrain database will not be described in detail herein, The unit 25 for determining the compass bearing is provided with the information regarding the geographical position of the tank 1 provided by the GPS-receiver 10 via the memory 14. The accuracy of the determination is improved by using the information about the distance to one or more landmarks provided by the laser range finder 13 via the memory 14 and the information about the geographical position(s) of said landmark(s) provided by the image processing unit 24. The compass bearing of the barrel 3 is then determined based on the known geographical positions of the tank 1 and the landmark(s) and the location in the image of the landmark(s). In one example the compass bearing of the barrel is saved in the memory 14 and/or distributed as information 5 via the network 6.

The accuracy of the determination is dependent on the accuracy of the sensors and the resolution of the image and the quality of the data of the terrain database 11.

In one example, the device 16 is provided with information related to the position of the target, preferably via the network 6. If the target is visible in the image of the scene, the compass bearing determining unit 25 can then be arranged to determine the compass bearing of the directing means also based on the position of the target.

The target is usually movable and the position can then be determined for example using a global positioning system (GPS) or differential global positioning system (DGPS). If the target is stationary, its position is preferably marked in the terrain database and accordingly dealt with as a landmark.

Once the compass bearing of the directing means is known, the virtual projectile/missile's ballistic trajectory is calculated which allows the simulation system to determine which, if any, participants in the exercise have been hit. The information about the determined compass bearing is accordingly used for determining a ballistic trajectory for subsequent hit evaluation, either locally at the shooting tank 1, the target tank 2 or at a central unit (not shown). In the latter case, wherein the hit evaluation is performed at the central unit, the information 5 related to the determined compass bearing is transmitted to the central unit (not shown) via the central network 6. In the case wherein the hit evaluation is performed at the target tank 2, the tank 2 is provided with the information 5 related to the determined compass bearing via the central network 6. In the case wherein the hit evaluation is performed locally at the shooting tank 1, the result of the hit evaluation may be transmitted to the central unit and/or the target tank 2 via the network 6.

All of the participants taking part in the simulation exercise are informed as to whether they have been hit via the central network 6, for example, and, if so, they are provided with the extent of the injury/damage caused by the hit i.e. the damage that would have been caused had that target been hit in such a way by a real projectile/missile. Such information is for example provided on a visual display unit carried by the participants 1, 2 in the simulation exercise or by flashing lights and/or an audio signal.

Figure 3:
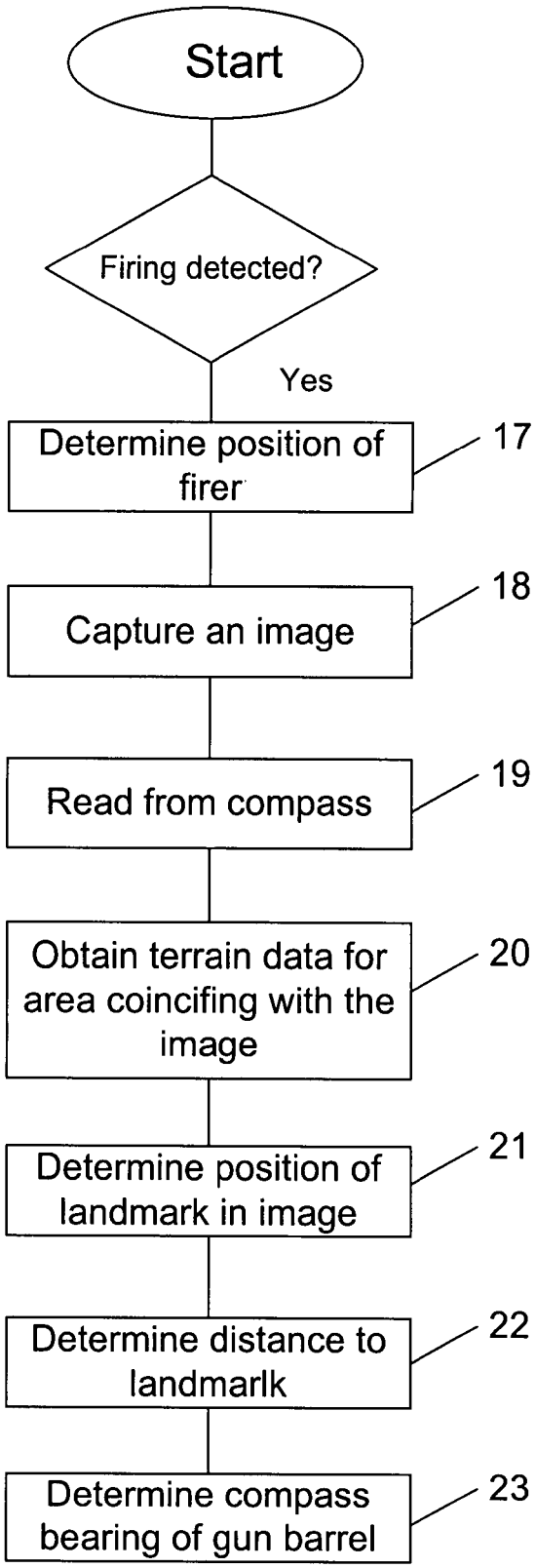
FIG. 3 is a flow chart describing the inventive method according to an embodiment of the invention.

In FIG. 3, a method for determining the compass bearing of directing means 3 of a virtual projectile/missile firing device 1 comprises the steps of, upon detection of a fired shot, determining 17 the position of the virtual projectile/missile firing device 1, and capturing 18 at least one image of the scene in front of the directing means 3. The position of the virtual projectile/missile firing device is for example determined using a global positioning system (GPS) or differential global positioning system (DGPS). The method also comprises the step of processing 21 the, or each, image in order to identify at least one landmark and to associate said landmark to a position. The processing step 21 presupposes that data has been obtained 20 from a terrain database. In one example the processing step 21 involves correlating topographic data extracted from the image with data of the terrain database. The compass bearing of the directing means (3) is finally determined 23 using information concerning the position of at least one landmark in the, or each, image and the position of the virtual projectile/missile firing device (1).

In the example of FIG. 3 the measure of a compass is read 19 and said measure is used in obtaining 20 a subset of the terrain database data coinciding with the location of the image in order to facilitate the correlation of the data from the database with the image.

In the example of FIG. 3, the method further comprises the step of determine 22 the distance to one or more landmarks. The determination 22 involves the steps of emitting a laser beam from the virtual projectile/missile firing device (1) towards at least one identified landmark, receiving at least a part of said laser beam reflected in the landmark at the virtual projectile/missile firing device (1), and determining the distance to said landmark based on a time of flight of said reflected laser beam. Said determined distance can then be used for improving the accuracy in the determination 23 of the compass bearing.

The invention is of course not in any way restricted to the embodiments thereof described above, but many possibilities to modifications thereof would be apparent to a man with ordinary skill in the art without departing from the basic idea of the invention as defined in the appended claims.

The invention claimed is:

1. A simulation system, comprising:

at least one virtual projectile/missile firing device associated to a determined geographical position, a movable directing element arranged to direct a virtual projectile/missile from the at least one virtual projectile/missile firing device towards a target, an image capturing unit arranged to capture at least one image of an actual scene in front of the directing element, wherein the image capturing unit is mounted in a fixed and known position in relation to the movable directing element, a terrain database comprising landmarks each associated with a geographical position, and a processing unit arranged to process the image of the scene so as to identify at least one landmark of the terrain database in the image, wherein said processing unit is configured to identify the landmark and determine the geographical position associated with the landmark by correlating topographic data extracted from the image with data of the terrain database, and wherein said processing unit is further arranged to determine a compass bearing of the directing element based on at least the determined geographical position of the virtual projectile/missile firing device and the geographical position associated with the identified at least one landmark.

2. The simulation system according to claim 1, further comprising:

a compass configured to provide a preliminary indication of the compass bearing of the directing element.

3. The simulation system according to claim 1, further comprising:

a laser range finder arranged to determine a distance to at least one of the identified landmarks, wherein the processing unit is arranged to determine the compass bearing of said directing element based on the determined at least one distance.

4. The simulation system according to claim 1, further comprising:

a position determining unit configured to determine the geographical position of the target, wherein if the target is visible in the image of the scene the processing unit is arranged to determine the compass bearing of the directing element also on the geographical position of the target.

5. The simulation system according to claim 1, wherein the image capturing unit comprises at least one optic or infrared camera.

6. The simulation system according to claim 1, wherein the image capturing unit is mounted on the movable directing element.

7. The simulation system according to claim 1, wherein the virtual projectile/missile firing device comprises a position determining module configured to determine a position of the movable directing element.

8. The simulation system according to claim 1, further comprising:

a central network configured to receive/send/store and/or communicate information concerning the position of said at least one virtual projectile/missile firing device and/or the compass bearing of the directing element to any, or all, participants in a simulation exercise and optionally to a third party.

9. The simulation system according to claim 7, wherein the position determining module utilizes signals from a global positioning system or differential global positioning system.

10. The simulation system, according to claim 1, wherein the movable directing element comprises a barrel.

11. A method for determining a compass bearing of directing element of a virtual projectile/missile firing device, the method comprising:

determining a geographical position of the virtual projectile/missile firing device via a geographic positioning element, capturing with an image capturing unit at least one image of an actual scene in front of the directing element, wherein the image capturing unit is mounted in a fixed and known position in relation to the movable directing element, processing the at least one image with a processor in order to identify at least one landmark, associating with the processor said at least one landmark with a geographical position using data in a terrain database by correlating topographic data extracted from the image with data of the terrain database, and determining with the processor a compass bearing of the directing element using information concerning the determined geographical position of at least one landmark in the, or each, image and the geographical position associated with the virtual projectile/missile firing device.

12. The method according to claim 11, further comprising:

identifying the landmark by correlating topographic data extracted from the image with data of the terrain database.

13. The method according to claim 11, further comprising:

obtaining a preliminary indication of the compass bearing of the directing element, and determining a relevant geographic area of the terrain database to be searched, based on the preliminary indication, in the determination of the geographical position of the landmark.

14. The method according to claim 11, further comprising:

emitting a laser beam from the virtual projectile/missile firing device towards at least one identified landmark, receiving at least a part of said laser beam reflected in the landmark at the virtual projectile/missile firing device, determining the distance to said landmark based on a time of flight of said reflected laser beam, and using said determined distance in the determination of the compass bearing.

15. The method according to claim 11, wherein said geographical positioning element is a global positioning system or differential global positioning system.

16. A computer program product, comprising:

a non-transitory computer readable medium; and computer program instruction recorded on the computer readable medium and executable by a processor for determining a geographical position of a virtual projectile/missile firing device via a geographic positioning element, capturing with an image capturing unit at least one image of an actual scene in front of a movable directing element, wherein the image capturing unit is mounted in a fixed and known position in relation to the movable directing element, image processing of the at least one image of the actual scene in order to identify at least one landmark and associate said at least one landmark with a geographical position using data in a terrain database by correlating topographic data extracted from the at least one image with data of the terrain database to determine a compass bearing of a directing element of a virtual projectile/missile firing device using information concerning the determined geographical position of at least one landmark in the at least one image and the geographical position associated with the virtual projectile/missile firing device.

17. The method according to claim 11, wherein an effect of any projectile/missile fired from a fixed or moving virtual projectile/missile firing device is simulated.

* * * * *